US006192839B1

(12) United States Patent
Takeshita et al.

(10) Patent No.: US 6,192,839 B1
(45) Date of Patent: Feb. 27, 2001

(54) COOLING APPARATUS FOR CONSTRUCTION MACHINE, AND CONSTRUCTION MACHINE

(75) Inventors: Seiichirou Takeshita; Osamu Watanabe, both of Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/308,268

(22) PCT Filed: Sep. 18, 1998

(86) PCT No.: PCT/JP98/04207

§ 371 Date: May 17, 1999

§ 102(e) Date: May 17, 1999

(87) PCT Pub. No.: WO99/15794

PCT Pub. Date: Apr. 1, 1999

(30) Foreign Application Priority Data

Sep. 19, 1997 (JP) ..... 9-255088

(51) Int. Cl.[7] ..... F01P 7/10

(52) U.S. Cl. ..... 123/41.49; 165/41; 165/51

(58) Field of Search ..... 123/41.11, 41.12, 123/41.49; 165/41, 51

(56) References Cited

U.S. PATENT DOCUMENTS 5,839,397 * 11/1998 Funabashi et al. ..... 123/41.01

FOREIGN PATENT DOCUMENTS

| | | |
|---|---|---|
| 2-5711 | 3/1914 | (JP) . |
| 51-21744 | 8/1949 | (JP) . |
| 57-50553 | 11/1982 | (JP) . |
| 59-29666 | 2/1984 | (JP) . |
| 63-4400 | 1/1988 | (JP) . |
| 7-42384 | 8/1995 | (JP) . |
| 8-27835 | 1/1996 | (JP) . |
| 8-254119 | 10/1996 | (JP) . |

* cited by examiner

*Primary Examiner*—Henry C. Yuen
*Assistant Examiner*—Katrina B. Harris
(74) *Attorney, Agent, or Firm*—Mattingly, Stanger & Malur

(57) ABSTRACT

A cooling apparatus for a construction machine, has at least one heat exchanger including a radiator for cooling water used to cool an engine of a hydraulic excavator, and a rotating cooling fan for producing cooling air to cool the heat exchanger. A substantially disk-shaped flow guide means having an outer diameter size smaller than an outer diameter size of the cooling fan is provided on the blowoff side of the cooling fan.

8 Claims, 9 Drawing Sheets

COOLING APPARATUS FOR CONSTRUCTION MACHINE, AND CONSTRUCTION MACHINE

TECHNICAL FIELD

The present invention relates to a cooling apparatus for a construction machine, and more particularly to a cooling apparatus for a construction machine which is adapted to cool heat exchangers, such as a radiator and an oil cooler, with a fan driven by an engine, and a construction machine provided with the cooling apparatus.

BACKGROUND ART

Heretofore, there has been known a cooling apparatus for cooling a heat exchanger with a fan driven by an engine. JP, U, 63-4400, for example, discloses a cooling apparatus comprising a heat exchanger, a propeller fan whose rotary shaft is rotated by the driving force of an engine to produce a stream of cooling air for cooling the heat exchanger, and a shroud provided downstream of the heat exchanger for introducing the cooling air to the suction side of the propeller fan, wherein a substantially disk-shaped back plate is provided just behind rotor blades of the propeller fan on the blowoff side, the back plate having almost the same diameter as an outline of the propeller fan. Such a construction is effective to avoid the occurrence of turbulence caused by interference between a main stream of the cooling air produced in the centrifugal direction on the blowoff side of the propeller fan and a reverse stream tending to return toward the heat exchanger side after being separated from the main stream, and hence to reduce noise generated by the fan.

DISCLOSURE OF THE INVENTION

In the field of construction machines, a movement to make regulations on noise and vibration of construction machines more strict has recently appeared for protecting the living environment of inhabitants, and it is nearly certain that the more strict regulations will be enforced in near future. One example of modified regulations is described below. At present, noise evaluation is performed by evaluating the no-load maximum revolution speed of an engine when the body of a construction machine is in a static condition (i.e., stationary noise evaluation). Evaluation under a dynamic condition of the body of a construction machine, more specifically, under simulated working loads during such operations as excavation, traveling and turning, (i.e., working noise evaluation) will be adopted instead in the future. Also, according to the current regulations, noise is measured in a planar manner at plural points spaced a predetermined distance from the body in four directions laterally of the body. The noise measurement will be made instead three-dimensionally at plural points locating on a hemisphere around the body. Further, the current noise measurement only requires the body to be positioned on the surface of the hard ground. It will be required instead for hydraulic excavators, for example, to basically position the machine on concrete or asphalt in noise measurement. Then, for hard ground, it will be obliged to add a modification value to the basically measured noise value.

Under the background set forth above, future construction machines will be required to suppress noise down to a lower level than that allowed currently.

To cope with the requirement, it is conceivable to reduce noise by applying the above-mentioned prior art to a cooling apparatus for a construction machine. In this case, a substantially disk-shaped back plate, which has almost the same diameter as a propeller fan rotatably driven by an engine of the construction machine, is provided between the propeller fan and the engine.

In that case, noise can be reduced, but a flow rate of air necessary for cooling heat exchangers, such as a radiator and an oil cooler, cannot be ensured at a sufficient level because a resistance of a main stream of cooling air in the centrifugal direction is increased and the flow rate of is reduced. Insufficient cooling of a radiator would mar cooling of an engine and deteriorate combustion efficiency of the engine, thus resulting in a reduction of engine power. Also, insufficient cooling of an oil cooler would expedite thermal deterioration of hydraulic working oil used for operating hydraulic equipment, thus resulting in a reduction of performance of the hydraulic equipment (e.g. hydraulic pump, control valves, hydraulic cylinders). Further, in recent construction machines including intercoolers, the intercooler is also cooled with the cooling air. Insufficient cooling of the intercooler would raise the temperature of intake air of the engine, thus resulting in the problem of further deteriorating combustion efficiency of the engine and lowering engine power correspondingly.

On the other hand, cooling apparatus adapted for application to construction machines are proposed aiming at an increase of the flow rate of air and a reduction of noise. JP, A, 8-254119, for example, discloses a cooling apparatus comprising, as with the above-mentioned cooling apparatus for general machines, a heat exchanger, an propeller fan, a shroud, and a substantially disk-shaped back plate, wherein a diameter size of the substantially disk-shaped back plate is limited to be not larger than an outline of rotor blades, and a flow guide in the form of fixed baffle blades is provided on the outer peripheral side of the substantially disk-shaped back plate. With this structure, swirling components of cooling air blown off from the propeller fan are rectified into axial components to recover dynamic pressure loss, thereby increasing the air flow rate and reducing noise.

However, another problem below arises when such a cooling apparatus is applied to construction machines.

In some of hydraulic excavators, for example, the engine revolution speed can be set to a value optimum for a working form by selecting a mode corresponding to the working form. One of four modes is selected, by way of example; i.e., an idling mode where the engine is idling at a low revolution speed, a fine operating mode which is suitable when actuators are desired to operate at a slow speed in, e.g., leveling or lifting work, an economy mode which is suitable when it is desired to save energy during excavation, and a power mode which is suitable when actuators are desired to operate with strong power to obtain a great excavating force. In this case, the engine revolution speed is set to, by way of example, about 600–900 rpm (on no-load condition; this is equally applied to the following rpm value) when the idling mode is selected, about 1500 rpm when the fine operating mode is selected, about 1800 rpm when the economy mode is selected, and about 2200 rpm when the power mode is selected. Thus, the mode selection causes a difference in engine revolution speed on the order of about maximum 1600 rpm.

Also, while work is being performed in one selected mode, the engine revolution speed may vary depending on change of a load during the work. It is known, for example, that when a relief valve in a hydraulic circuit is operated, the engine revolution speed usually lowers about 100 rpm. It is also known that at the moment when the load is maximized during the so-called deep digging, the engine revolution speed lowers about 300 rpm.

Further, in construction machines with an auto-idling function, even when any of other modes than the idling mode is selected, the engine revolution speed lowers down to the idling revolution speed temporarily upon shift to the auto-idling operation.

As mentioned above, the engine revolution speed may vary over a considerably wide range in construction machines. A variation of the engine revolution speed also changes the revolution speed of a fan driven by the engine to a large extent. Each time the fan revolution speed changes, the swirling components of cooling air blown off from the fan are changed in direction and speed.

In the cooling apparatus disclosed in JP, A, 8-254119, the flow guide serving as baffling means is in the form of fixed blades. Therefore, the flow guide can efficiently rectify only those swirling components of cooling air which have the direction and the speed in a certain narrow range substantially uniquely corresponding to the configuration of the fixed blades. For the other swirling components of cooling air than mentioned above, the flow guide cannot effectively develop its own specific rectifying effect, but rather gives large resistance and disturbs the stream of cooling air, thereby reducing the air flow rate and increasing noise. Accordingly, it is difficult to practically apply the proposed cooling apparatus to construction machines in which the engine revolution speed varies over a wide range.

An object of the present invention is to provide a cooling apparatus for construction machine which can reduce noise down to a lower level than that allowed currently, while ensuring a sufficient flow rate of air.

To achieve the above object, the present invention provides a cooling apparatus for a construction machine, comprising at least one heat exchanger including a radiator for cooling water used to cool an engine of the construction machine, and a cooling fan for producing cooling air to cool the heat exchanger driven by means of a rotary shaft. A substantially disk-shaped flow guide means having an outer diameter size smaller than an outer diameter size of the cooling fan is provided on the blowoff side of the cooling fan.

The provision of the substantially disk-shaped flow guide means on the blowoff side of the cooling fan makes it possible to avoid interference between a main stream of the cooling air produced by the cooling fan in the centrifugal direction and a reverse flow separated from the main stream and tending to return toward the center of the cooling fan, to prevent the occurrence of turbulence, and hence to reduce noise caused by the cooling fan. In this connection, by setting the outer diameter size of the flow guide means to be smaller than the outer diameter size of the cooling fan, the outer diameter size of the flow guide means is kept from becoming so excessively large as to give resistance against the stream of the cooling air. Therefore, noise can be reduced with more certainty, and a reduction in flow rate of air can be restrained. Further, in this connection, the air flow rate is ensured and noise is reduced by adjusting the outer diameter of the flow guide means rather than by rectifying swirling components of the cooling air with the fixed baffle blades as proposed in the prior-art structure. Accordingly, even when the engine revolution speed of the construction machine varies over a wide range and the swirling components of the cooling air vary in direction and speed, a sufficient flow rate of the cooling air can be ensured and noise can be reduced at all times regardless of such variations.

As a result, noise can be reduced down to a lower level than that allowed currently, while ensuring a sufficient flow rate of the cooling air, in consideration of the tendency toward more strict regulations on construction machines.

Preferably, the flow guide means has an outer diameter size that is not less than 60% but less than 100% of the outer diameter size of the cooling fan.

By setting the outer diameter size of the flow guide means to be not less than 60%, the outer diameter size of the flow guide means is kept from becoming so excessively small as to reduce the effect of preventing the interference between the main stream of the cooling air and the reverse stream separated from the main stream. Accordingly, noise can be surely reduced.

More preferably, the flow guide means has an outer diameter size that is not less than 60% but not more than 80% of the outer diameter size of the cooling fan.

With that feature, it is possible to attain a larger flow rate of the cooling air and less noise than resulted when the outer diameter size of the flow guide means is set to be not less than 80% but not more than 100% of the outer diameter size of the cooling fan. Accordingly, noise can be more surely reduced and a sufficient flow rate can be more surely ensured.

Also, preferably, a curved portion having a shape curving toward the downstream side of the cooling air is provided at an outer portion of the flow guide means.

With the provision of the curved portion, the centrifugal main stream can be more smoothly introduced to the downstream side, and therefore noise can be further reduced.

Preferably, a rugged portion for increasing a contact area with the cooling air is provided at an outer portion of the flow guide means.

With an increased contact area resulted from the provision of the rugged portion, when a plurality of turbulences are caused upon the cooling air contacting the outer portion of the flow guide means, the magnitude of each turbulence can be made smaller. As a result, noise can be further reduced.

Preferably, the cooling fan is a propeller fan.

Preferably, the flow guide means is fixed to the engine through support means.

For example, if the flow guide means is fixed to a shroud, the specific frequency of the shroud, which is a solid body, would be changed and would resonate with vibration of the flow guide means caused by wind pressure of the cooling air, thereby further increasing noise. By fixing the flow guide means to the engine side, such a resonance can be avoided and noise can be surely reduced.

To achieve the above object, the present invention also provides a construction machine comprising an engine, a hydraulic pump driven by the engine, actuators driven with a hydraulic fluid delivered from the hydraulic pump, and a cooling apparatus comprising at least one heat exchanger including a radiator for cooling water used to cool the engine, a cooling fan for producing cooling air to cool the heat exchanger by means of a rotary shaft being driven, and substantially disk-shaped flow guide means provided on the blowoff side of the cooling fan and having an outer diameter size smaller than an outer diameter size of the cooling fan.

Preferably, the flow guide means of the cooling apparatus has an outer diameter size that is not less than 60% but less than 100% of the outer diameter size the cooling fan.

More preferably, the flow guide means of the cooling apparatus has an outer diameter size that is not less than 60% but not more than 80% of the outer diameter size of the cooling fan.

BEST MODE FOR CARRYING OUT THE INVENTION

One embodiment of a cooling apparatus for a construction machine according to the present invention will be described with reference to the drawings.

This embodiment represents the case where the present invention is applied to a hydraulic excavator as one example of construction machines.

Figure 1:
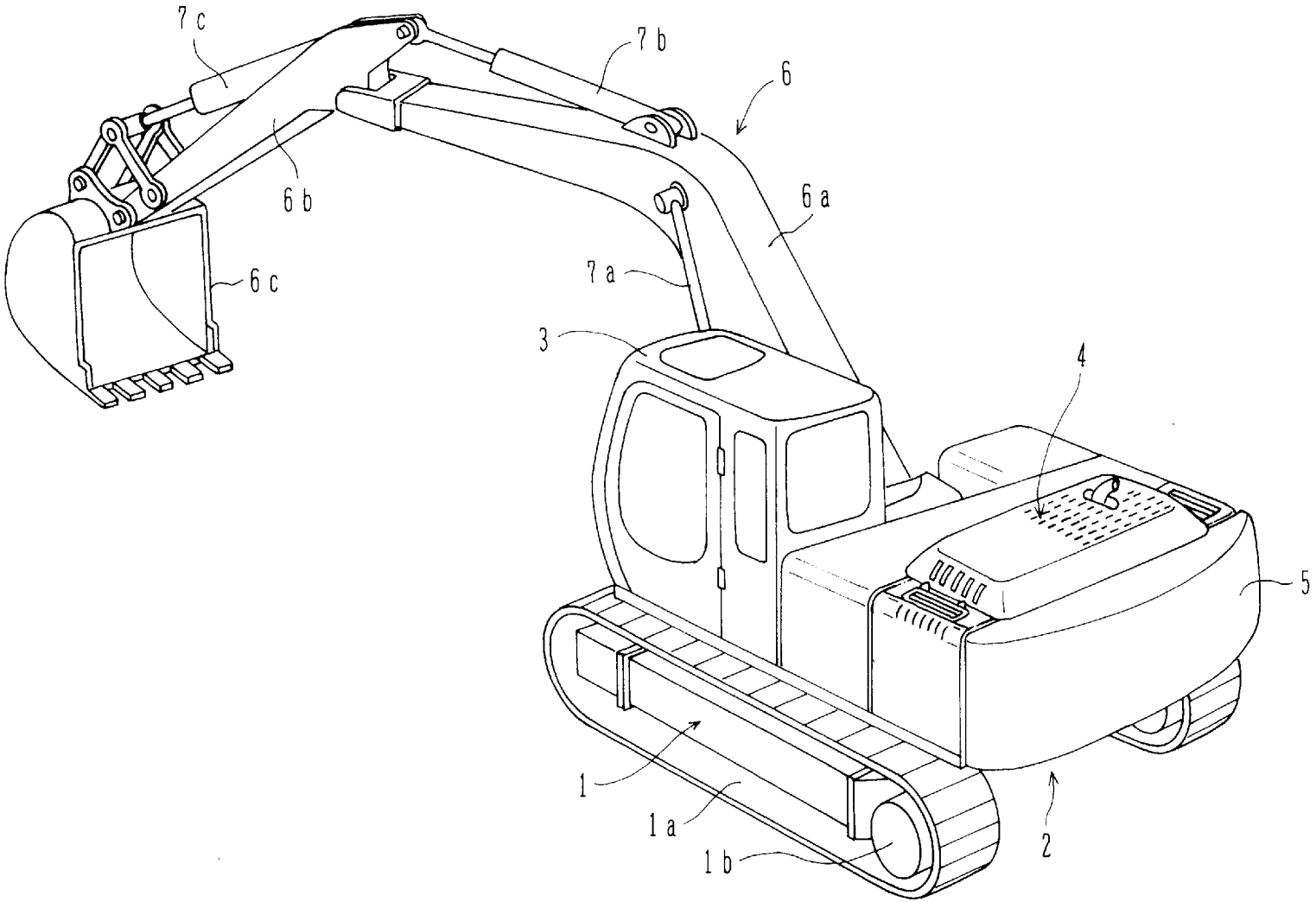
FIG. 1 is a perspective view showing an overall appearance structure of a hydraulic excavator to which a cooling apparatus according to one embodiment of the present invention is applied.

FIG. 1 is a perspective view showing an overall appearance structure of a hydraulic excavator to which a cooling apparatus according to one embodiment of the present invention is applied. Roughly speaking, the illustrated hydraulic excavator comprises a track body 1, a swing structure 2 mounted on the track body 1 to be able to swing, a cab 3 provided in front of the swing structure 2 on the left side, an engine unit 4 disposed on the swing structure 2 to positioned horizontally, a counterweight 5 provided at a rear portion of the swing structure 2, and a multi-articulated front device 6 attached to a front portion of the swing structure 2 and made up of a boom 6*a*, an arm 6*b* and a bucket 6*c*.

The track body 1 includes a pair of crawler belts 1*a* on both left and right sides. The crawler belts 1*a* are driven by the driving forces of respective track motors 1*b*.

The swing structure 2 including the cab 3, the engine compartment 4, the counterweight 5, the multi-articulated front device 6, etc. is swung relative to the track body 1 by a swing motor (not shown) which is provided in a central portion of the swing structure 2.

The boom 6*a*, the arm 6*b*, and the bucket 6*c* of the multi-articulated front device 6 are operatively driven by a boom cylinder 7*a*, an arm cylinder 7*b*, and a bucket cylinder 7*c* respectively associated with them.

Driving equipment such as the cylinders 7*a*, 7*b*, 7*c*, the swing motor, and the track motors 1*b* are hydraulic actuators (e.g., oil-hydraulic actuators; this is equally applied to "hydraulic actuator" appearing below), and are driven with a hydraulic fluid, that is supplied through a control valve device (not shown) for controlling a hydraulic fluid from a hydraulic pump (not shown, see FIG. 3 below) driven by an engine (not shown, see FIG. 3 below) in the engine compartment 4, in response to an input amount from a control lever manipulated by an operator in the cab 3.

Figure 2:
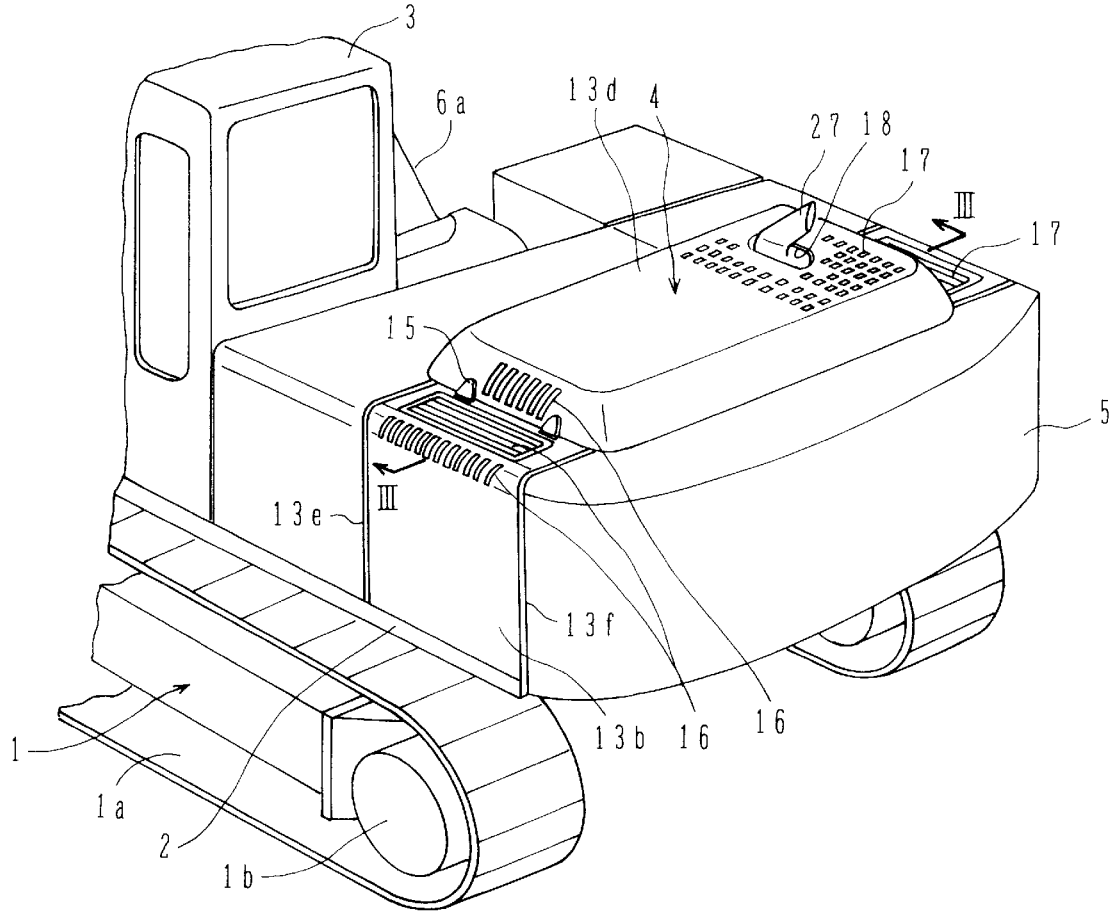
FIG. 2 is an enlarged perspective view showing an appearance structure of an engine compartment to which the cooling apparatus according to one embodiment of the present invention is applied.
Figure 3:
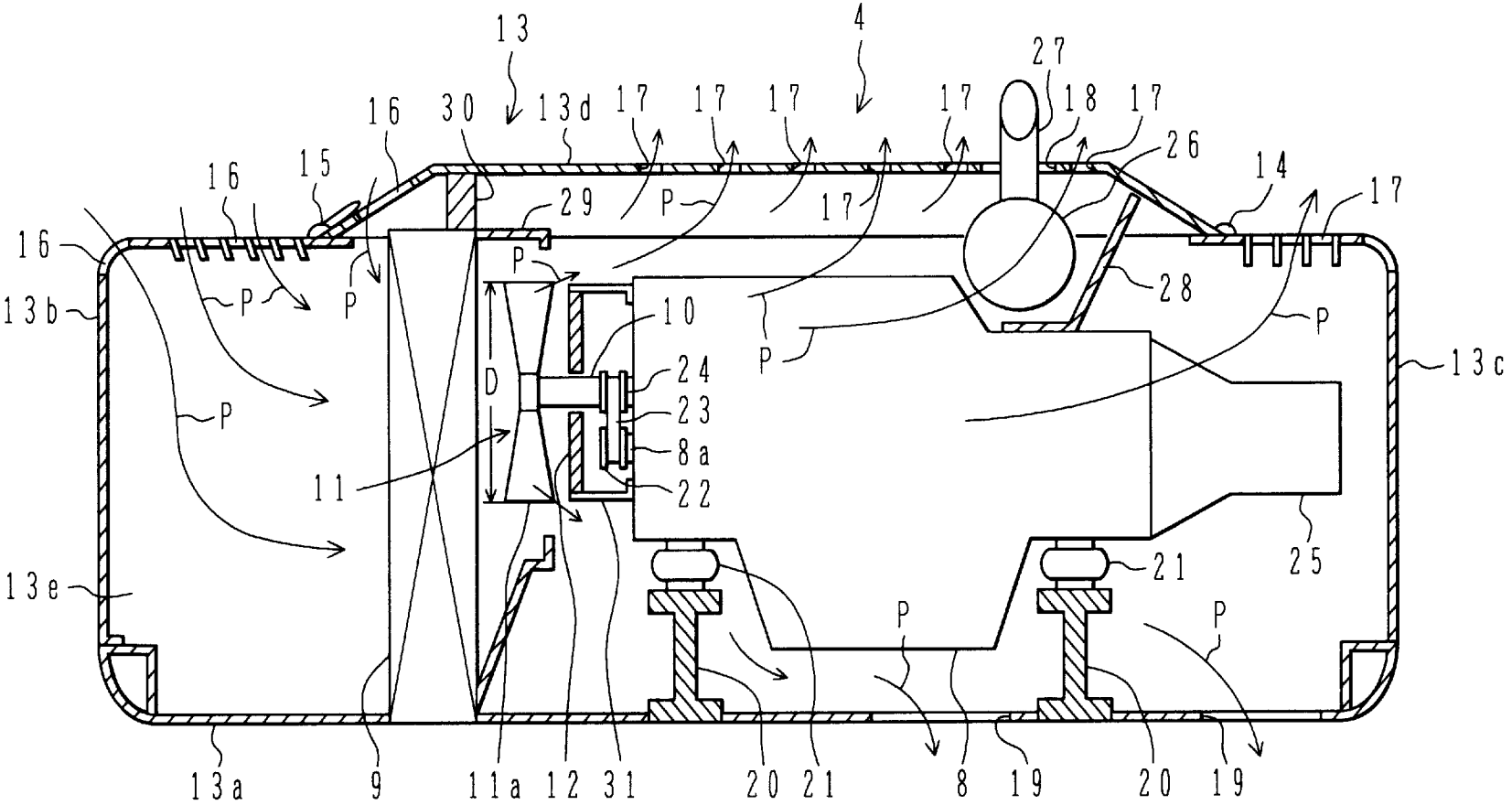
FIG. 3 is a side view, partly sectioned, showing a detailed structure of an engine unit in which the cooling apparatus according to one embodiment of the present invention is provided.

FIG. 2 is an enlarged perspective view showing an appearance structure of the engine compartment 4 to which the cooling apparatus according to this embodiment is applied. FIG. 3 is a side view, partly sectioned, showing a detailed structure of the engine unit 4 in which the cooling apparatus according to this embodiment is provided. Note that the same symbols in FIGS. 2 and 3 as those in FIG. 1 denote the same components.

In FIGS. 2 and 3, the cooling apparatus is provided within the engine unit 4, and comprises a radiator 9 which is a heat exchanger for cooling water used to cool an engine 8, a cooling fan 11 for producing cooling air P to cool the radiator 9 by means of an auxiliary rotary shaft 10 being driven, and a substantially disk-shaped flow guide means 12 provided on the blowoff side of the cooling fan 11.

An outer shell of the engine unit 4 is constituted by an engine cover 13 which covers such equipment as the engine 8, the cooling fan 11, the radiator 9, a hydraulic pump (described later), and a muffler (described later). The engine cover 13 is made up of a lower cover 13*a*, a suction-side (left-hand) lateral cover 13*b*, a delivery-side (right-hand) lateral cover 13*c*, an upper cover 13*d*, a front cover 13*e*, and a rear cover 13*f*.

One end of the upper cover 13*d* is attached to the delivery-side lateral cover 13*c* by a hinge 14 to be able to open and close, and latches 15 are provided at the other end of the upper cover 13*d* so that the opening/-closing-side end of the upper cover 13*d* is latched to the suction-side lateral cover 13*b*. In a portion of the upper cover 13*d* on the side adjacent to the radiator 9 and in the suction-side lateral cover 13*b*, suction ports 16 are formed for taking in streams of air (cooling air) P from the exterior and introducing the taken-in air to the cooling fan 11. Also, in the upper cover 13*d* and the delivery-side lateral cover 13*c*, delivery ports 17, 18 are formed for discharging the streams of air (cooling air) P blown from the cooling fan 11 to the exterior. Further, delivery ports 19 are formed in the lower cover 13*a* on the side near the hydraulic pump (described later).

The engine 8 is installed through vibration dampers 21 on a frame 20 which is provided in a lower portion of the swing structure 2 and serves as a framework of the swing structure 2. The driving force from a crankshaft 8*a* of the engine 8 is transmitted to the auxiliary rotary shaft 10 through a pulley 22, a fan belt 23 and a pulley 24. A water pump (not shown) for circulating engine cooling water through the radiator 9 is coupled to the other end of the auxiliary rotary shaft 10 opposite to the cooling fan 11. Also, a hydraulic pump 25, referred to in the above, is provided on the opposite side of the engine 8 near the delivery-side lateral cover 13*c*. The hydraulic pump 25 is coupled to the engine 8 through a gear mechanism (not shown), and is driven by the driving force of the engine 8. Exhaust gas from the engine 8 is discharged outside the engine unit 4 through an exhaust gas pipe 27 after passing through a muffler 26 for arrest of sound. Additionally, a muffler cover 28 is fixedly provided above the engine 8 to prevent oil from scattering toward the engine 8 from the hydraulic pump 25.

The cooling fan 11 usually comprises a propeller fan, and includes an impeller 11*a* which is constituted by a plurality of rotor blades fixed to the auxiliary rotary shaft 10. Thus, the auxiliary rotary shaft 10 serves as a fan rotary shaft of the cooling fan 11. A shroud 29 for introducing the cooling air P to the suction side of the cooling fan 11 is fixedly provided downstream of the radiator 9. Incidentally, a gap between the radiator 9 and the upper cover 13*d* is sealed off by a seal member 30.

Figure 4:
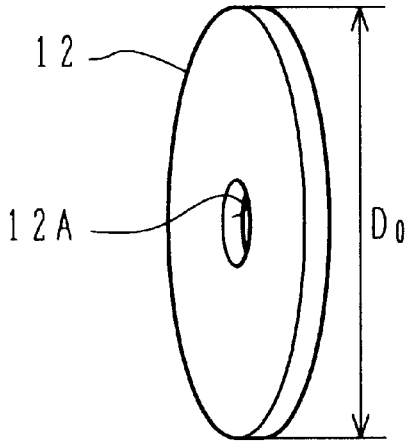
FIG. 4 is a perspective view showing a detailed configuration of flow guide means according to one embodiment of the present invention.

The flow guide means 12 is arranged between the cooling fan 11 and the engine 8. As seen from FIG. 4 showing a detailed configuration, the flow guide means 12 is constituted by a substantially disk-shaped member having a through hole 12A formed at the center, of which the diameter is larger than that of the auxiliary rotary shaft 10 and through which the auxiliary rotary shaft 10 penetrates. The substantially disk-shaped member is made of, e.g., a metal or a plastic and so on. Preferably, the diameter of the through hole 12A is set as close as possible to the diameter of the auxiliary rotary shaft 10 from the points of air flow rate and noise. Also, the flow guide means 12 has an outer diameter size Do that is, e.g., about 80% of an outer diameter size D of the cooling fan 11. The flow guide means 12 is fixed to the engine 8 through a support means 31 and is held in the above-mentioned position. Here, the support means 31 comprises, for example, a plurality of arms which are fixed at one end to the flow guide means 12 by welding and at the other end to the engine 8 by bolts.

Note that at radiator 9 is the least one example of heat exchangers to be cooled by the cooling air P, and is illustrated in a not-limiting sense. Stated differently, in the case of providing any other heat exchangers such as an oil cooler for cooling the hydraulic fluid used to drive the hydraulic actuators 7*a*–7*c* etc., an intercooler for cooling intake air used for combustion in the engine 8 beforehand, and a condenser for an air conditioner as the occasion requires, one or more of those heat exchangers are disposed along with the radiator 9 so that they are cooled together with the cooling air P.

The operation of the foregoing cooling apparatus according to this embodiment will now be described.

When the engine 8 is started up, the driving force is transmitted from the crankshaft 8*a* to the auxiliary rotary shaft 10 through the fan belt 23, whereupon the auxiliary rotary shaft 10 is rotated. With the rotation of the auxiliary rotary shaft 10, the cooling fan 11 is also rotated and air outside the cover 13 is introduced as the cooling air P to the interior of the engine unit 4 through the suction ports 16 and then cools the radiator 9. After cooling the radiator 9, the cooling air P is restricted by the shroud 29 and then flows into the cooling fan 11. The cooling air P blown off from the cooling fan 11 strikes against the flow guide means 12, followed by efficiently flowing in the centrifugal direction. Then, after cooling the engine 8, the muffler 26, the hydraulic pump 25, etc., the cooling air P is discharged outside the engine unit 4 through the delivery ports 17, 18, 19.

Operating effects of this embodiment constructed as set forth above will be described below one by one.

(1) Noise Reducing Effect Resulted from Prevention of Interference with Separated Reverse Stream As mentioned above, the cooling air P is blown off from the cooling fan 11 toward the engine 8. Although the cooling fan 11 is a propeller fan, the cooling air P blown off from the cooling fan 11 mainly flows out in the centrifugal direction, as shown in FIG. 3, at the current fan operating point (low flow rate and high pressure) in hydraulic excavators for the reasons that the cooling air is radially restricted by the shroud 29, and the interior of the engine unit 4 is sealed off at a high degree.

Figure 5:
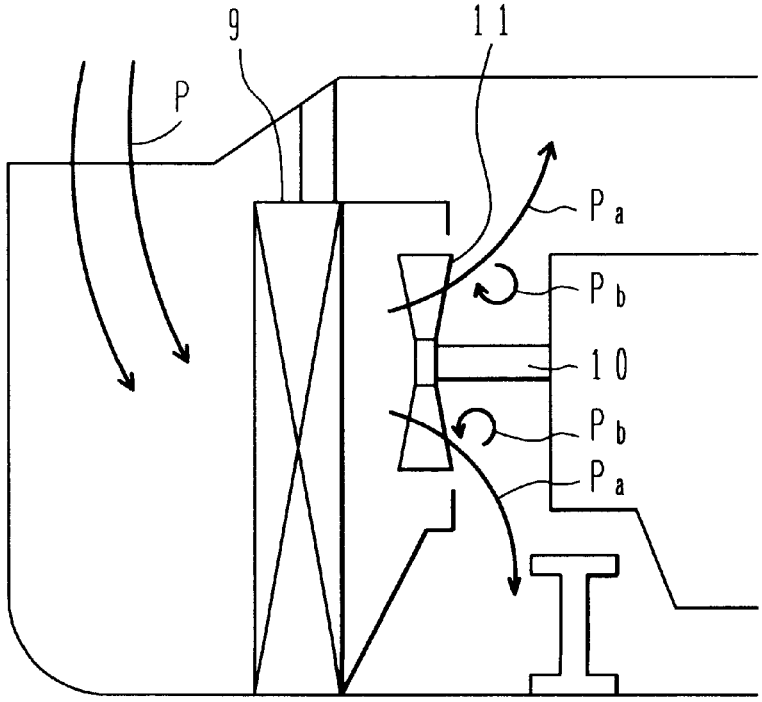
FIG. 5 is a representation showing behaviors of cooling air resulting when the flow guide means according to one embodiment of the present invention is not provided.

If the flow guide means 12 is not provided, a main stream Pa of the cooling air P created in the centrifugal direction on the blownoff side of the cooling fan 11 would interfere with a reverse stream Pb separated from the main stream Pa and tending to return toward the radiator 9 from the vicinity of the auxiliary rotary shaft 10, as shown in FIG. 5. The interference between both the streams would cause turbulence and increase noise.

Figure 6:
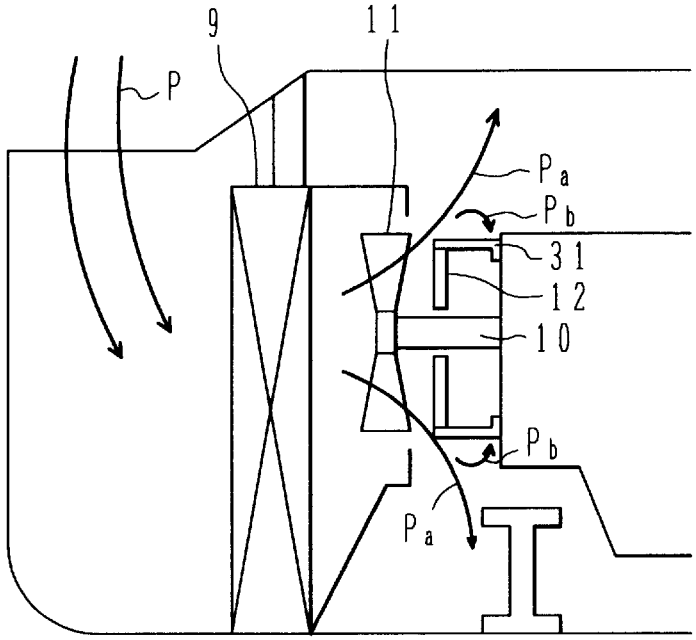
FIG. 6 is a representation showing behaviors of cooling air in the cooling apparatus, shown in FIG. 1, according to one embodiment of the present invention.

By contrast, the flow guide means 12 provided in this embodiment functions to prevent the interference between the reverse stream Pb and the main stream Pa of the cooling air P in the centrifugal direction, and hence to avoid the occurrence of turbulence, as shown in FIG. 6. This point will be described in more detail with reference to FIG. 7.

Figure 7:
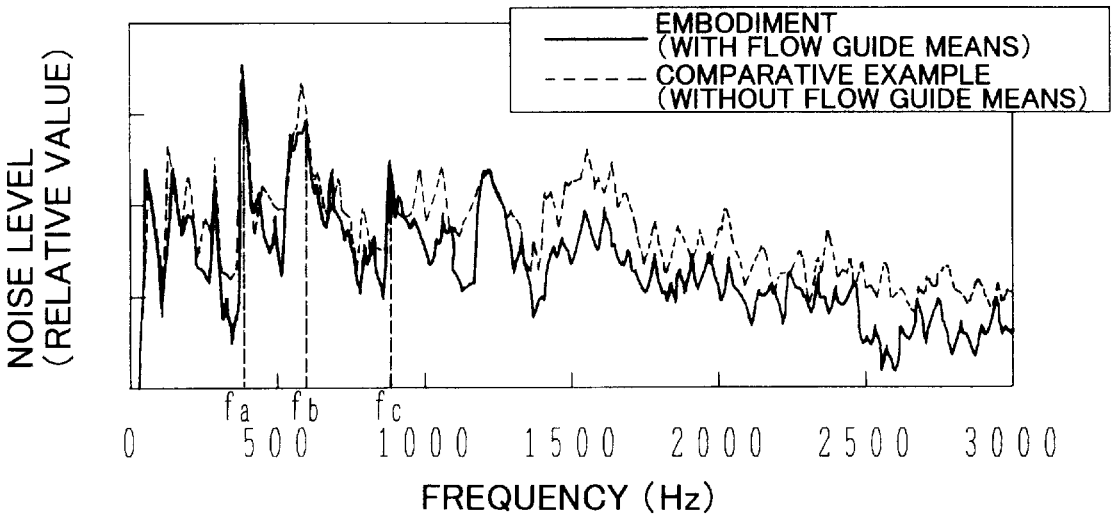
FIG. 7 is a graph representing comparison of results of noise measurement obtained depending on whether or not the flow guide means according to one embodiment of the present invention is provided.

FIG. 7 shows results of noise measurement obtained by rotating the cooling fan 11, while the revolution speed of the engine 8 is fixed to a predetermined value, in both an engine unit similar to the engine unit 4 according to this embodiment and a comparative example, i.e., an engine unit which is prepared by removing the flow guide means 12 and the support means 31 from the same engine unit. The results obtained from the former engine unit are indicated by a solid line, and the results obtained from the latter engine unit are indicated by a broken line. In the graph of FIG. 7, the horizontal axis represents frequency [Hz] and the vertical axis represents relative values of a noise level. As shown, it has proved that the noise level of the engine unit 4 according to this embodiment is lower than that of the comparative example in the almost entire frequency range of 0 Hz to 3000 Hz.

Consequently, the engine unit 4 according to this embodiment can reduce noise generated by the cooling fan 11.

(2) Effect Resulting from Smaller Outer Diameter of Flow Guide Means (2-A) Effect of Promoting Noise Reduction To study influences of the outer diameter size of the flow guide means 12 upon noise, the inventors conducted experiments of measuring, in the aforementioned engine unit similar to the engine unit 4 according to this embodiment, levels of noise produced when a ratio of (the outer diameter size Do of the flow guide means 12)/(the outer diameter size D of the cooling fan 11) is reduced gradually from 100% to 60% while the revolution speed of the engine 8 is fixed to each of 2000 rpm substantially corresponding to the power mode mentioned above and 1500 rpm substantially corresponding to the fine operating mode. Results shown in FIG. 8 were then obtained.

Figure 8:
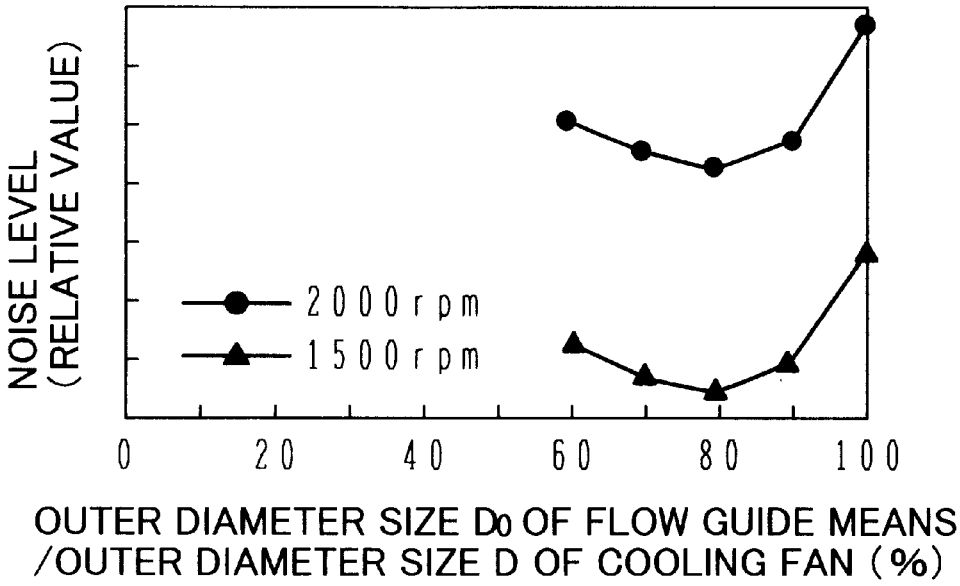
FIG. 8 is a graph representing results of noise measurement obtained when a ratio of the outer diameter size of the flow guide means according to one embodiment of the present invention to the outer diameter size of a cooling fan is changed.

In FIG. 8, in any of the cases where the engine revolution speed is set to 2000 rpm and 1500 rpm, when the Do/D ratio is reduced from 100%, the noise level decreases quickly until Do/D=90%. The noise level then decreases at a rate that becomes smaller gradually, followed by minimizing at Do/D=80%. When the Do/D ratio is further reduced, the noise level rises gently and takes a larger value at Do/D=70% than at Do/D=80%. Also, at Do/D=60%, the noise level takes a larger value than at Do/D=70%. However, at Do/D=60%, the noise level takes a smaller value than at Do/D=100%. Stated otherwise, in the range of Do/D=60%–90%, the noise level is lower than that at Do/D=100%. It is thus found that Do/D=80% is an optimum value for reduction of noise.

Such a behavior occurs for the reason below. When the Do/D ratio is larger than 80%, the outer diameter size Do of the flow guide means 12 exceeds above the optimum value. This results in that the flow guide means 12 gives resistance against the stream of the cooling air P and noise tends to increase. On the other hand, when the Do/D ratio is smaller than 80%, the outer diameter size Do of the flow guide means 12 exceeds below the optimum value. This diminishes the effect of preventing the interference, described above in connection with FIGS. 5 and 6, between the main stream Pa of the cooling air P and the reverse stream Pb separated from the main stream Pa. Consequently, noise tends to increase due to turbulence caused by the interference of both streams.

From the above, it is understood that if the Do/D value is less than 100%, noise can be reduced down to a lower level than that produced at least in the case of Do/D=100% (i.e., where the flow guide means 12 and the cooling fan 11 have the same outer diameter).

(2-B) Effect of Ensuring Air Flow Rate

Further, to study influences of the outer diameter size of the flow guide means 12 upon a flow rate of the cooling air P, the inventors conducted experiments of measuring, in the aforementioned engine unit similar to the engine unit 4 according to this embodiment, air flow rates produced when the Do/D ratio is reduced gradually from 100% to 60% while the revolution speed of the engine 8 is fixed to each of 2000 rpm and 1500 rpm as with the above case (2-A). Results shown in FIG. 9 were then obtained. For comparison, results of measurement made in the case of Do/D=0% (i.e., where the flow guide means 12 is not provided) are also shown in FIG. 9.

Figure 9:
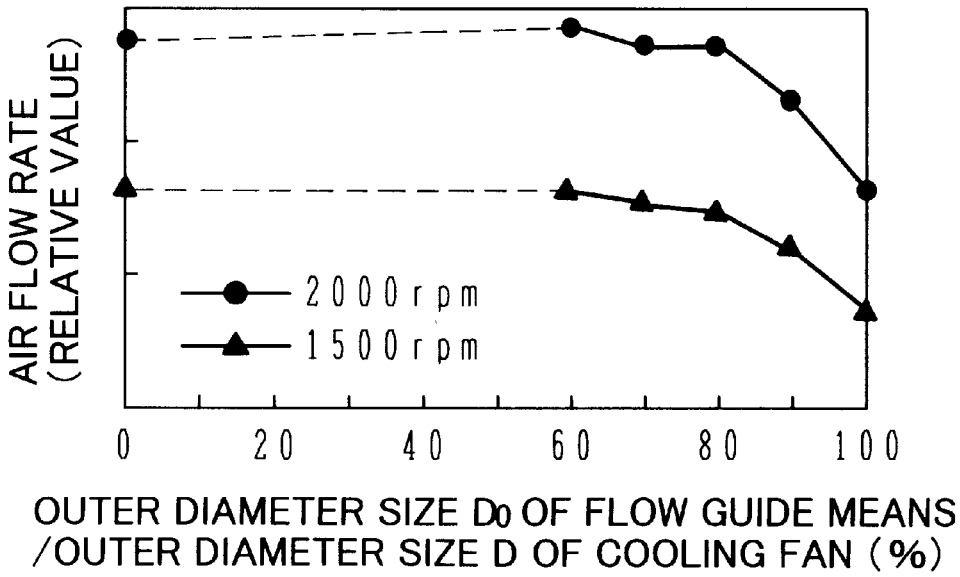
FIG. 9 is a graph representing results of air flow rate measurement obtained when a ratio of the outer diameter size of the flow guide means according to one embodiment of the present invention to the outer diameter size of the cooling fan is changed.

In FIG. 9, when the Do/D ratio is reduced from 100%, the air flow rate increases while its increase rate becomes smaller gradually. The air flow rate at Do/D=80% is almost equal to that at Do/D=0%. Then, at Do/D=60%, the air flow rate takes a somewhat larger value at Do/D=0%. Such a behavior occurs for the reason below. When the Do/D ratio is larger than 80%, the outer diameter size Do of the flow guide means 12 exceeds above the optimum value. This results in that the flow guide means 12 gives resistance against the stream of the cooling air P and the air flow rate tends to decrease.

From the above, it is understood that if the Do/D value is less than 100%, the air flow rate can be increased to a higher level than that obtained at least in the case of Do/D=100%, and particularly that in the range of Do/D=60%–80%, the air flow rate comparable to that in the case of Do/D=0% can be ensured.

(2-C) Range where Noise Reducing Effect and Air Flow Rate Ensuring Effect are Obtained From the above (2-A) and (2-B), it is understood that if the Do/D value is less than 100%, noise can be reduced, while increasing the air flow rate, as compared with at least the case of Do/D=100% (i.e., where the flow guide means 12 and the cooling fan 11 have the same outer diameter). It is also understood that the Do/D value is preferably set to be not less than 60% but not more than 80%, and it is optimum to set Do/D=80%.

In this embodiment, the flow guide means 12 is designed to have Do/D=80% as mentioned above. As a result, noise can be reduced while ensuring a sufficient flow rate of the cooling air P.

(3) Adaptability for Construction Machines

Because of this embodiment ensuring the air flow rate and reducing noise based on the effects described in the above (2), even when this embodiment is applied to construction machines in which the engine revolution speed may vary over a wide range, it is possible to always ensure a sufficient flow rate of the cooling air and reduce noise regardless of such a variation unlike the prior-art structure disclosed in the above-cited JP, A, 8-254119. This point will be described with reference to FIG. 10–12.

Figure 10:
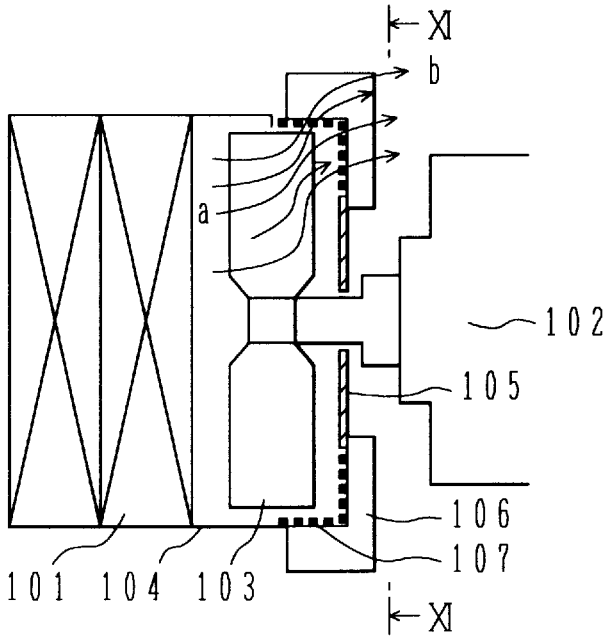
FIG.10 PRIOR ART
FIG. 10 is a schematic side sectional view showing a structure of a cooling apparatus according to a prior-art structure.
Figure 11:
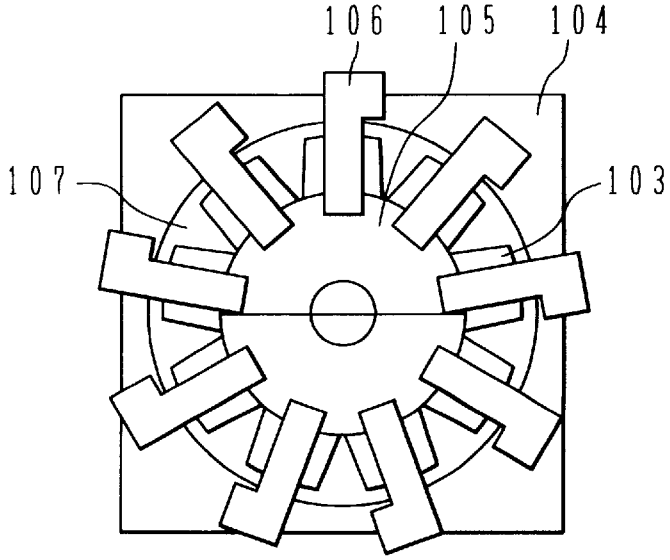
FIG.11 PRIOR ART
FIG. 11 is a representation taken along the line XI—XI in FIG. 10 as viewed in the direction of a arrows.

FIG. 10 is a schematic side sectional view showing a structure of a cooling apparatus according to a prior-art structure, and FIG. 11 is a representation taken along the line XI—XI in FIG. 10 as viewed in the direction of arrows. In the FIGS. 10 and 11, the cooling apparatus comprises a heat exchanger 101, an propeller fan 103 driven by an engine 102, a shroud 104, and a substantially disk-shaped back plate 105. The back plate 105 has a diameter size limited to be not larger than an outline of rotor blades of the propeller fan 103, and a flow guide 106 in the form of fixed baffle blades is provided on the outer side of the back plate. Incidentally, a safety protective net 107 for avoiding accidental contact of a worker is provided inward of the flow guide 106.

Figure 12:
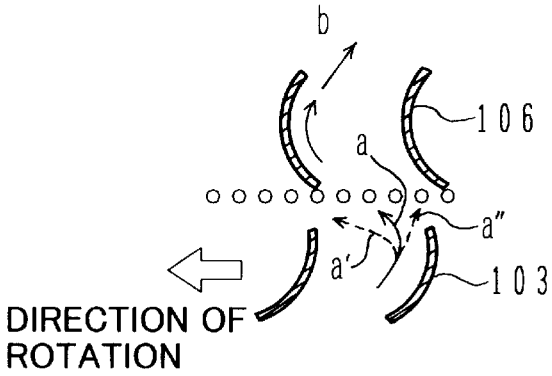
FIG.12 PRIOR ART
FIG. 12 is a representation showing a manner of rectifying swirling components of cooling air blown off from an propeller fan into axial components in the cooling apparatus according to the prior-art structure.

With the above structure, as shown in FIG. 12, swirling components a of cooling air blown off from the propeller fan 103 are rectified into axial components b to recover dynamic pressure loss, thereby increasing the air flow rate and reducing noise.

In hydraulic excavators, for example, however, the engine revolution speed may usually vary over a wide range of, e.g., 600 rpm–2200 rpm due to a difference in the working mode described above, a variation of excavation load, etc. Accordingly, the revolution speed of a fan driven by an engine is also changed to a large extent, and for each change of the fan revolution speed, the swirling components of cooling air blown off from the fan are changed in direction and speed. In the prior-art cooling apparatus shown in FIGS. 10–12, since the flow guide 106 serving as baffling means is in the form of fixed blades, the flow guide 106 can efficiently rectify only those swirling components of cooling air which have the direction and the speed in a certain narrow range substantially uniquely corresponding to the configuration of the fixed blades. For the other swirling components of cooling air than mentioned above, the flow guide 106 cannot effectively rectify, e.g., a stream a' produced when the fan is rotating at a high speed and a stream a" produced when the fan is rotating at a low speed, shown in FIG. 12, because the angle of the fixed blades of the flow guide 106 does not match with those streams. In other words, the flow guide cannot effectively develop its own specific rectifying effect. The flow guide 106 rather gives large resistance and disturb the stream of cooling air, thereby reducing the air flow rate and increasing noise. Accordingly, it is difficult to practically apply the prior-art structure to construction machines in which the engine revolution speed varies over a wide range.

By contrast, this embodiment is designed to ensure the air flow rate and reduce noise by adjusting the outer diameter of the flow guide means 12 rather than by rectifying the swirling components with the fixed baffle blades as proposed in the above prior-art structure. Also, the inventors conducted experiments, similar to those mentioned in the above (2-A), (2-B) and providing the results shown in FIGS. 8 and 9, while setting the engine revolution speed over the range of 1500 rpm–2200 rpm at predetermined intervals. Then, the inventors confirmed that measured characteristics were similar to those shown in FIGS. 8 and 9, and that substantially identical results were obtained (though experiment results are not shown). It was thus found that, by setting the Do/D value to be less than 100%, preferably not less than 60% but not more than 80%, even when the engine revolution speed of the engine 8 of a hydraulic excavator varies over a wide range and the swirling components of the cooling air P vary in direction and speed, a sufficient flow rate of the cooling air P can be ensured and noise can be reduced at all times regardless of such variations.

As described in the above (1)–(3), the cooling apparatus of this embodiment is constructed as a cooling apparatus which can reduce noise down to a lower level than that allowed currently, while ensuring a sufficient flow rate of the cooling air P, even when applied to hydraulic excavators, and is hence adaptable for the tendency toward more strict regulations on construction machines.

Moreover, the following advantages are attained in addition to the above advantages.

For example, if the flow guide means 12 is fixed to the shroud 29, vibration of the flow guide means 12 subjected to the wind pressure of the cooling air P would be transmitted to the shroud 29, and the specific frequency of the shroud 29, which is a solid body, would be changed due to, e.g., addition of the weight of the flow guide means 12. On the other hand, noise caused by vibration induced with the wind pressure of the cooling air P exhibits such a frequency characteristic as shown in FIG. 7, and the noise level becomes relatively high at several peak frequencies indicated by, e.g., fa, fb and fc in FIG. 7. Accordingly, if the specific frequency of the shroud 29 is changed, there is a possibility that the changed specific frequency may align with any of the peak frequencies depending on behavior of the change. In such an event, the shroud 29 would resonate with the vibration transmitted from the flow guide means 12 to the shroud 29. Hence, a resulting increase of noise would possibly cancel the noise reducing effect based on the above (1).

By contrast, with the cooling apparatus of this embodiment, the possibility of resonance of the shroud 29 can be eliminated by fixing the flow guide means 12 to the engine 8 through the support means 31. As a result, noise can be surely reduced.

Further, in the case of fixing the flow guide means 12 to the shroud 29, since the auxiliary rotary shaft 10 belongs to a vibrating system which vibrates in unison with the engine 8, a relatively large clearance must be left between the through hole 12A and the auxiliary rotary shaft 10 to avoid collision between the flow guide means 12 and the auxiliary rotary shaft 10. By contrast, in this embodiment, since the flow guide means 12 is fixed to the engine 8, both the flow guide means 12 and the auxiliary rotary shaft 10 belong to the same vibrating system. This means that the clearance between the through hole 12A and the auxiliary rotary shaft 10 can be set to a minimum. The minimum clearance contributes to further restraining leakage of noise from the engine to the side of the cooling fan 11, and hence to reducing noise.

Note that the present invention is not limited to the embodiment set forth above, but can be modified in various ways without departing from the scope of the invention. Several modifications will be described below.

(a) Flow guide means Having Curved Portion at Outer Portion

Figure 13:
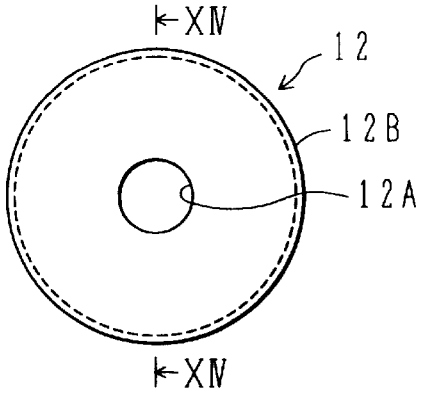
FIG. 13 is a front view showing a modification of the flow guide means according to one embodiment of the present invention.
Figure 14:
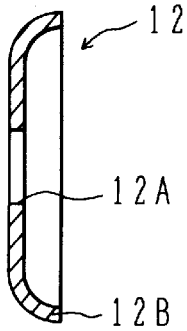
FIG. 14 is a sectional view taken along the section XIV—XIV in FIG. 13.

In this modification, as seen from FIGS. 13 and 14 which are respectively a front view and a sectional view taken along the section XIV—XIV, a curved portion 12B curving toward the downstream side of cooling air (toward the engine 8 side, for example, when applied to the construction of FIG. 1) is formed at an outer periphery of the substantially disk-shaped flow guide means 12. By using the flow guide means 12 having such a structure, the curved portion 12B acts to more smoothly introduce a centrifugal flow of the main stream Pa to the engine 8 side. As a result, noise can be further reduced in addition to the advantages of the above embodiment.

(b) Flow guide means Having Ragged Portion at Outer Portion

Figure 15:
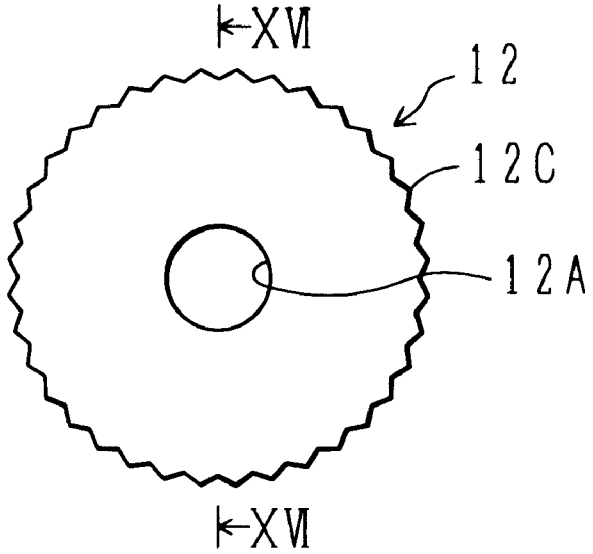
FIG. 15 is a front view showing another modification of the flow guide means according to one embodiment of the present invention.
Figure 16:
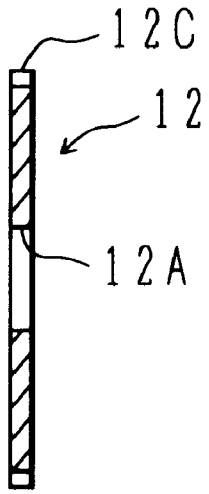
FIG. 16 is a sectional view taken along the section XVI—XVI in FIG. 15.

In this modification, as seen from FIGS. 15 and 16 which are respectively a front view and a sectional view taken along the section XVI—XVI, a ragged portion, e.g., a serrated portion 12C, for increasing a contact area with cooling air is formed at an outer periphery of the substantially disk-shaped flow guide means 12. By using the flow guide means 12 having such a structure, the increased contact area provided by the serrated portion 12C acts to make smaller the magnitude of each turbulence when turbulences are caused upon the cooling air P contacting the flow guide means 12. As a result, noise can be further reduced in addition to the advantages of the above embodiment.

According to the present invention, in consideration of the tendency toward more strict regulations on construction machines, noise can be reduced down to a lower level than that allowed currently, while ensuring a sufficient flow rate of cooling air. As a result, it is possible to provide a construction machine capable of protecting the living environment of inhabitants.

What is claimed is:

1. A cooling apparatus for a construction machine, comprising at least one heat exchanger including a radiator for cooling water used to cool an engine of said construction machine, and a cooling fan for producing cooling air to cool said heat exchanger and driven by means of a rotary shaft, wherein:

substantially disk-shaped flow guide means having an outer diameter size smaller than an outer diameter size of said cooling fan is provided on the blowoff side of said cooling fan, and said flow guide means has an outer diameter size that is not less than 60% but not more than 80% of the outer diameter size of said cooling fan.

2. A cooling apparatus for a construction machine, comprising at least one heat exchanger including a radiator for cooling water used to cool an engine of said construction machine, and a cooling fan for producing cooling air to cool said heat exchanger and driven by means of a rotary shaft, wherein:

substantially disk-shaped flow guide means having an outer diameter size smaller than an outer diameter size of said cooling fan is provided on the blowoff side of said cooling fan, and a curved portion having a shape curving toward the downstream side of said cooling air is provided at an outer portion of said flow guide means.

3. A cooling apparatus for a construction machine, comprising at least one heat exchanger including a radiator for cooling water used to cool an engine of said construction machine, and a cooling fan for producing cooling air to cool said heat exchanger and driven by means of a rotary shaft, wherein:

substantially disk-shaped flow guide means having an outer diameter size smaller than an outer diameter size of said cooling fan is provided on the blowoff side of said cooling fan, and a ragged portion for increasing a contact area with said cooling air is provided at an outer portion of said flow guide means.

4. A construction machine comprising an engine, a hydraulic pump driven by said engine, actuators driven with a hydraulic fluid delivered from said hydraulic pump, and a cooling apparatus comprising at least one heat exchanger including a radiator for cooling water used to cool said engine, a cooling fan for producing cooling air to cool said heat exchanger by means of a rotary shaft, and substantially disk-shaped flow guide means provided on the blowoff side of said cooling fan and having an outer diameter size smaller than an outer diameter size of said cooling fan.

5. A construction machine according to claim 4, wherein said flow guide means of said cooling apparatus has an outer diameter size that is not less than 60% but less than 100% of the outer diameter size of said cooling fan.

6. A construction machine according to claim 4, wherein said flow guide means of said cooling apparatus has an outer diameter size that is not less than 60% but not more than 80% of the outer diameter size of said cooling fan.

7. A construction machine according to claim 4, wherein said cooling fan is a propeller fan.

8. A construction machine according to claim 4, wherein said flow guide means is fixed to said engine through support means.

* * * * *